US005089163A

United States Patent [19]

Aronson et al.

[11] Patent Number: 5,089,163

[45] Date of Patent: * Feb. 18, 1992

[54] ENZYMATIC LIQUID DETERGENT COMPOSITION

[75] Inventors: Michael P. Aronson, West Nyack, N.Y.; Martin S. Cardinali, Millington; Jack T. McCown, Cresskill, both of N.J.

[73] Assignee: Lever Brothers Company, Division of Conopco, Inc., New York, N.Y.

[ * ] Notice: The portion of the term of this patent subsequent to Sep. 25, 2007 has been disclaimed.

[21] Appl. No.: 575,270

[22] Filed: Aug. 30, 1990

Related U.S. Application Data

[63] Continuation-in-part of Ser. No. 304,394, Jan. 30, 1989, Pat. No. 4,959,179.

[51] Int. Cl.[5] ..... C11D 3/386; C11D 7/42

[52] U.S. Cl. ..... 252/135; 252/174.12; 252/DIG. 12; 252/DIG. 14

[58] Field of Search ..... 252/174.12, DIG. 12, 252/135

[56] References Cited

U.S. PATENT DOCUMENTS

| | | | |
|---|---|---|---|
| 4,261,888 | 4/1981 | Hora et al. | 252/529 |
| 4,404,115 | 9/1983 | Tai | 252/135 |
| 4,462,922 | 7/1984 | Boskamp | 252/174.12 |
| 4,465,619 | 8/1984 | Boskamp | 252/540 |
| 4,532,064 | 7/1985 | Boskamp | 252/105 |
| 4,537,706 | 8/1985 | Severson | 252/545 |
| 4,537,707 | 8/1985 | Severson | 252/545 |
| 4,566,985 | 1/1986 | Bruno et al. | 252/174.12 |
| 4,707,291 | 11/1987 | Thom | 252/174.12 |
| 4,810,414 | 3/1989 | Huge-Jensen et al. | 252/174.12 |
| 4,824,599 | 4/1989 | de Jong et al. | 252/174.12 |

FOREIGN PATENT DOCUMENTS

| | | |
|---|---|---|
| 1092036 | 12/1980 | Canada . |
| 0080223 | 6/1983 | European Pat. Off. . |
| 0258068 | 3/1988 | European Pat. Off. . |
| 0271156 | 6/1988 | European Pat. Off. . |
| 0348183A2 | 12/1989 | European Pat. Off. . |
| 47-35192 | 11/1972 | Japan . |
| 2079305 | 1/1982 | United Kingdom . |
| 2140818A | 12/1984 | United Kingdom . |
| 2140819A | 12/1984 | United Kingdom . |

OTHER PUBLICATIONS

"Equilibria Between Borate Ion and Some Polyols in Aqueous Solution", Conner et al., *J. Inorg. Nucl. Chem.*, (vol. 29), 1967, pp. 1953, 1958.

European Search Report for EP 90 20 0155, 5/15/91.

*Primary Examiner*—Paul Lieberman
*Assistant Examiner*—A. Beadles-Hay
*Attorney, Agent, or Firm*—James J. Farrell

[57] ABSTRACT

The invention relates to the stabilization of mixtures of proteolytic and lipolytic enzymes in a liquid medium such as a liquid detergent composition. By inclusion therein of a stabilizing system comprising a polyol and a boron compound which are capable of reacting with each other whereby the polyol has a first binding constant with the boron compound of at least 500 l/mole and a second binding constant of at least 1,000 $l^2$/mole$^2$, the stability of the lipase in the presence of the protease is significantly improved.

The lipase is preferably obtained from *Humicola lanuginosa*, and the stabilizing system preferably comprises a mixture of sorbitol and borax.

2 Claims, No Drawings

ENZYMATIC LIQUID DETERGENT COMPOSITION

BACKGROUND OF THE INVENTION

This application is a continuation-in-part application of co-pending Ser. No. 304,394 filed on Jan. 30, 1989, now U.S. Pat. No. 4,951,179.

FIELD OF THE INVENTION

The present invention relates to enzymatic liquid detergent compositions comprising both lipolytic and proteolytic enzymes, wherein the storage stability of the lipolytic enzymes is improved by the inclusion in the composition of a particular enzyme-stabilizing system.

DESCRIPTION OF THE RELATED ART

Enzymatic liquid detergent compositions are well-known in the art. They mainly contain a proteolytic enzyme, or a mixture of a proteolytic enzyme and an amylolytic enzyme. One of the major problems which is encountered with such enzymatic liquid detergent compositions is that of ensuring a sufficient storage-stability of the enzymes in these compositions.

There have already been various proposals for the inclusion of a variety of special enzyme-stabilising systems in such enzymatic liquid detergent compositions. A number of these proposals are directed to the use of a combination of a polyol and a boron compound as an enzyme-stabilizing system. Thus, Canadian Patent 1,092,036 (Hora et al.) discloses enzymatic liquid detergents comprising a proteolytic and/or an amylolytic enzyme and an enzyme stabilizing system containing a polyol such as 1,2-propanediol, ethyleneglycol, erythritan, glycerol, sorbitol, mannitol, glucose, fructose, lactose, and a boron compound such as boric acid, boric oxide borax, alkalimetal ortho-, meta- and pyroborates which is capable of reacting with the polyol. In U.S. Pat. No. 4,404,115 (Tai), the combination of an alkalimetal pentaborate, optionally with an alkalimetal sulphite and/or a polyol is described as an enzyme-stabilizing system in enzymatic liquid detergents comprising a protease and/or an amylase.

In Japanese patent application 72/35,192 (Nagase), laid open to public inspection on Nov. 24, 1972, the use of mixtures of a polyol such as sorbitol or glycerol and borax to stabilize proteolytic enzymes in liquid detergents is disclosed.

There are several references disclosing enzymatic liquid detergent compositions which include the combination of a polyol and a boron compound in an enzyme-stabilizing system, e.g. British Patent 2,079,305 (Boskamp), European Patent 80,223 (Boskamp) and U.S. Pat. No. 4,537,707 (Severson), wherein the enzyme is a proteolytic and/or amylolytic enzyme.

In U.S. Pat. No. 4,465,619 (Boskamp) an enzymatic liquid detergent composition is described, which may contain proteases, amylases, cellulases or lipases, and an enzyme-stabilizing system comprising a mixture of a polyol and a boron compound. This composition may not contain more than about 2% by weight of the boron compound.

In European Patent Application 258,068 (NOVO) published on Mar. 2, 1988, a detergent lipase is described, which can be stabilized in an aqueous detergent composition by the inclusion therein of 1,2-propanediol, optionally together with a calcium salt. Sorbitol is stated to have only a slight stabilizing effect.

None of these prior proposals deal with enzyme-stabilizing systems to improve the stability of lipolytic enzymes in liquid detergent compositions which also include a proteolytic enzyme. It is therefore an object of the present invention to provide for an enzyme-stabilizing system which, when included in an enzymatic liquid detergent composition which includes both a lipase and a protease, would improve the storage stability of the lipase therein.

SUMMARY OF THE INVENTION

It has now surprisingly been found, that the above object of the invention can be achieved by using as an enzyme-stabilizing system a combination of a polyol and a boron compound, said polyol having predominantly vicinal hydroxyl groups and said boron compound being capable of reacting with said polyol, said polyol having a first binding constant to the boron compound of at least 500 l/mole and a second binding constant to the boron compound of at least 1,000 $l^2$/mole$^2$ as determined at 25° C. according to the method of Conner and Bulgrin, Journal of Inorganic Nuclear Chemistry, 1967, Vol. 29, pages 1953–1961.

Since lipases, being proteins, would be susceptible to proteolytic attack, it was unexpected to find that the above enzyme-stabilizing system, which embraces systems known to stabilize proteolytic enzymes, did not cause a decrease in the stability of the lipolytic enzyme on storage, but rather increased the storage stability of the lipolytic enzyme.

DETAILED DESCRIPTION OF THE INVENTION

The polyol, used in the present invention, should have vicinal hydroxyl groups and should be capable of forming a complex with the boron compound, having a first binding constant of at least 500 l/mole and a second binding constant of at least 1,000 $l^2$/mole$^2$ when reacted with the boron compound as determined at 25° C. according to the aforesaid method of Conner and Bulgrin, l.c.

The polyol should contain only C, H and O atoms and should contain at least two hydroxyl groups. Typical examples of suitable polyols for use in the present invention are D-mannitol, sorbitol and 1,2-benzenediol. Sorbitol is the preferred polyol.

In general, the polyol is used in the present invention in an amount of 1–20% by weight, preferably from 2–15% by weight of the final composition. The boron compound, used in the present invention, should be capable of forming a complex with the polyol. Typical examples of boron compounds, suitable in the present invention are boric acid, boric oxide, alkalimetal borates such as sodium and potassium ortho-, meta- and pyroborates, borax, and polyborates such as the alkalimetalpentaborates. Preferably the boron compound is sodium tetraborate $10.H_2O$ or $5.H_2O$. In general, the boron compound is used in an amount of 1–10% by weight, preferably from 2–6% by weight of the final composition.

Although the weight ratio of the polyol to the boron compound may vary to some extent, it is preferred that this weight ratio ranges from 0.5 to 3, and is particularly greater than 1.0.

Naturally, mixtures of the above polyols and mixtures of the above boron compounds and their variations may be used.

The lipolytic enzyme used in the present invention is either a fungal lipase producible by *Humicola lanuginosa* and *Thermomyces lanuginosus*, or a bacterial lipase which show a positive immunological cross-reaction with the antibody of the lipase produced by the micro-organism *Chromobacter viscosum* var. *lipolyticum* NRRL B-3673. This micro-organism has been described in Dutch patent specification 154 269 of Toyo Jozo Kabushiki Kaisha and has been deposited with the Fermentation Research Institute, Agency of Industrial Science and Technology, Ministry of International Trade & Industry, Tokyo, Japan, and added to the permanent collection under nr. Ko Hatsu Ken Kin Ki 137 and is available to the public at the United States Department of Agriculture, Agricultural Research Service, Northern Utilization and Development Division at Peoria, Ill., U.S.A., under the nr. NRRL B-3673. The lipase produced by this micro-organism is commercially available from Toyo Jozo Co, Tagata, Japan, hereafter referred to as "TJ lipase". These bacterial lipases of the present invention should show a positive immunological cross-reaction with the TJ lipase antibody, using the standard and well-known immunodiffusion procedure according to Ouchterlony (Acta. Med. Scan., 133, pages 76–79 (1950).

The preparation of the antiserum is carried out as follows:

Equal volumes of 0.1 mg/ml antigen and of Freund's adjuvant (complete or incomplete) are mixed until an emulsion is obtained. Two female rabbits are injected with 2 ml samples of the emulsion according to the following scheme:

day 0: antigen in complete Freund's adjuvant
day 4: antigen in complete Freund's adjuvant
day 32: antigen in incomplete Freund's adjuvant
day 60: booster of antigen in incomplete Freund's adjuvant The serum containing the required antibody is prepared by centrifugation of clotted blood, taken on day 67.

The titre of the anti-TJ-lipase antiserum is determined by the inspection of precipitation of serial dilutions of antigen and antiserum according to the Ouchterlony procedure. A $2^5$ dilution of antiserum was the dilution that still gave a visible precipitation with an antigen concentration of 0.1 mg/ml.

All bacterial lipases showing a positive immunological cross-reaction with the TJ-lipase antibody as hereabove described are lipases suitable in the present invention. Typical examples thereof are the lipase ex *Pseudomonas fluorescens* IAM 1057 available from Amano Pharmaceutical Co, Nagoya, Japan, under the trade-name Amano-P lipase, the lipase ex *Pseudomonas fragi* FERM P 1339 (available under the trade-name Amano-B), the lipase ex *Pseudomonas nitroreducens* var. *lipolyticum* FERM P 1338, the lipase ex *Pseudomonas sp.* available under the trade name Amano CES, the lipase ex *Pseudomonas cepacia*, lipases ex *Chromobacter viscosum*, e.g. *Chromobacter viscosum* var. *lipolyticum* NRRL B-3673, commercially available from Toyo Jozo Co., Tagata, Japan; and further *Chromobacter viscosum* lipases from U.S. Biochemical Corp., U.S.A. and Diosynth Co., The Netherlands, and lipases ex *Pseudomonas gladioli*.

An example of a fungal lipase as defined above is the lipase ex *Humicola lanuginosa*, available from Amano under the trade-name Amano CE; the lipase ex *Humicola lanuginosa* as described in the aforesaid European Patent Application 0258,068 (NOVO), as well as the lipase obtained by cloning the gene from *Humicola lanuginosa* and expressing this gene in *Aspergillus oryzae*, commercially available from NOVO Industri A/S under the trade name "Lipolase". This Lipolase is a preferred lipase for use in the present invention.

The lipases of the present invention are included in the liquid detergent composition in such an amount that the final composition has a lipolytic enzyme activity of from 100 to 0.005 LU/mg, preferably 25 to 0.05 LU/mg of the composition.

A Lipase Unit (LU) is that amount of lipase which produces 1 μmol of titratable fatty acid per minute in a pH stat. under the following conditions: temperature 30° C.; pH=9.0; substrate is an emulsion of 3.3 wt. % of olive oil and 3.3% gum arabic, in the presence of 13 mmol/l $Ca^{2+}$ and 20 mmol/l NaCl in 5 mmol/l Tris-buffer.

Naturally, mixtures of the above lipases can be used. The lipases can be used in their non-purified form or in a purified form, e.g. purified with the aid of well-known adsorption methods, such as phenyl sepharose adsorption techniques.

The proteolytic enzyme, used in the present invention, can be of vegetable, animal or microorganism origin. Preferably it is of the latter origin, which includes yeasts, fungi, molds and bacteria. Particularly preferred are bacterial subtilisin type proteases, obtained from e.g. particular strains of B. subtilis and B. licheniformis. Examples of suitable commercially available proteases are Alcalase, Savinase, Esperase, all of NONO Industri A/S; Maxatase and Maxacal of Gist-Brocades; Kazusase of Showa Denko; BPN and BPN' proteases and so on. The amount of proteolytic enzyme, included in the composition, ranges from 0.1–50 GU/mg, based on the final composition. Naturally, mixtures of different proteolytic enzymes may be used.

A GU is a glycine unit, which is the amount of proteolytic enzyme which under standard incubation conditions produces an amount of terminal $NH_2$-groups equivalent to 1 microgramme/ml of glycine.

The compositions of the invention furthermore may comprise one or more detergent-active materials such as soaps, synthetic anionic, nonionic, amphoteric or zwitterionic detergent materials or mixtures thereof. These materials are all well-known in the art. Preferably the compositions contain a nonionic detergent or a mixture of a nonionic and an anionic detergent. Nonionic detergents are well-known in the art. They are normally reaction products of compounds having a hydrophobic group and a reactive hydrogen atom, for example aliphatic alcohols, acids, amides or alkylphenols with alkylene oxides, especially ethylene oxide either alone or with propylene oxide. Typical examples of suitable nonionic detergents are alkyl ($C_6$–$C_{22}$) phenol-ethylene oxide condensation products, with generally 5–25 moles of ethylene oxide per mole of alkylphenol, the condensation products of aliphatic $C_8$–$C_{18}$ primary or secondary, linear or branched chain alcohols with generally 5–40 moles of ethylene oxide, and products made by condensation of ethylene oxide and propylene oxide with ethylenediamine. Other nonionic detergents include the block copolymers of ethylene oxide and propylene oxide, alkylpolyglycosides, tertiary amine-oxides and dialkylsulphoxides. The condensation products of the alcohols with ethylene oxide are the preferred nonionic detergents.

Anionic detergents, suitable for inclusion in the compositions of the present invention include the $C_{10}$–$C_{24}$ alkylbenzenesulphonates, the $C_{10}$–$C_{18}$ alkanesulphonates, the $C_{10}$–$C_{24}$ alkylethersulphates with 1–10 moles of ethylene and/or propyleneoxide in the ether variety and so on.

In general, the compositions may contain the detergent-active compounds in an amount of 5–90, usually 1–70 and preferably 15–50% by weight.

The liquid detergent compositions of the present invention can furthermore contain one or more other, optional ingredients. Such optional ingredients are e.g. perfumes, including deoperfumes, colouring materials, opacifiers, soil-suspending agents, soil-release agents, solvents such as ethanol, ethyleneglycol, propylene glycol, hydrotropes such as sodium cumene-, toluene- and xylenesulphonate as well as urea, alkaline materials such as mono-, di- or triethanol-amine, clays, fabric-softening agents and so on.

The liquid detergent composition may be unbuilt or built, and may be aqueous or non-aqueous. If a built liquid detergent composition is required, the composition may contain from 1–60%, preferably 5–30% by weight of one or more organic and/or inorganic builder. Typical examples of such builders are the alkalimetal ortho-, pyro- and tri-polyphosphates, alkalimetal carbonates, either alone or in admixture with calcite, alkalimetal citrates, alkalimetal nitrilotriacetates, carboxymethyloxy succinates, zeolites, polyacetal carboxylates and so on.

The compositions may furthermore comprise lather boosters, foam depressors, anti-corrosion agents, chelating agents, anti-soil redeposition agents, bleaching agents, other stabilizing agents for the enzymes such as glycerol, sodium formate, calcium salts and the like, activators for the bleaching agents and so on. They may also comprise enzymes other than the proteases and lipases, such as amylases, oxidases and cellulases. In general, the compositions may comprise such other enzymes in an amount of 0.01–10% by weight.

When the liquid detergent composition is an aqueous composition, the balance of the formulation consists of an aqueous medium. When it is in the form of a non-aqueous composition, the above ingredients together with the essential ingredients make up for the whole formulation.

More specifically, mixtures of detergent actives such as 0 to 40% anionic detergents may be combined with 0 to 40% nonionic detergents. The anionics may advantageously be alkyl benzene sulfonates, alkyl sulfates, alkyl ethoxy sulfates in combination with the nonionics which may be alcohol alkoxylates, alkyl phenol alkoxylates, alkyl polyglucosides, and alkyl glycerol ethers. 0% to 30% of a builder may also be used, the builder is advantageously alkali metal salts of citric acid, copolymers of acrylic and maleic acid, oxydisuccinate, tartrate monosuccinate-tartrate disuccinate, $C_8$ to $C_{18}$ carboxylic acids, and detergent zeolite builders, and combinations thereof. The $C_{8-18}$ carboxylic acids may also be considered as detergent actives. In addition to the stabilizer system of the invention, other conventional stabilizers may be used such as 0.1 to 10% of proteolytic enzyme stabilizers such as glycerol or propylene glycol in combination with sodium tetraborate, alkali metal salts of $C_1$ to $C_4$ carboxylic acids, calcium salts, and proteins and the like.

The invention will further be illustrated by way of Examples.

EXAMPLE I

The storage stability of Lipolase in water was assessed at 37° C. The Lipolase was present in an amount of 7500 LU/ml, and Savinase was present in an amount of 15,000 GU/ml. The pH of the solution was 7. The following Table represents the results of this assessment.

| | Lipase Stability @ 37° C. (% Left) Days | | | | |
|---|---|---|---|---|---|
| Solution Composition | 1 | 2 | 8 | 15 | 34 |
| Distilled water (pH7) + Savinase | 28 | 9 | 0 | — | — |
| Distilled water + 6% Sodium Tetraborate (10 $H_2O$) + 7% Sorbitol + Savinase (pH7) | 100 | 100 | 49 | 19 | 7 |

EXAMPLE II

The following citrate-built formulations were prepared.

| | Wt % in Formulation | | | | |
|---|---|---|---|---|---|
| Ingredients | 2.1 | 2.2 | 2.3 | 2.4 | 2.5 |
| $C_{10}$–$C_{13}$ Alkylpolyglycoside (ex Horizon 1:1 blend of APG 400 & 500) | 17 | 17 | 17 | 17 | 17 |
| $C_{12}$–$C_{15}$ Alcohol Ethoxylate with 9 moles of ethylene oxide | 7 | 7 | 7 | 7 | 7 |
| Sodium Citrate Dihydrate | 7 | 7 | 7 | 7 | 7 |
| Sodium Formate | — | 3 | — | 3 | — |
| Sorbitol | 7.1 | 7.1 | — | — | — |
| Sodium Tetra borate Decahydrate | 4 | 4 | — | 4 | 4 |
| Savinase 16.0/L | 0.375 | 0.375 | 0.375 | 0.375 | 0.375 |
| Lipolase | 7,500 LU per gram | | | | |
| Water | to 100% | | | | |

The Formulation 2.3 was adjusted to pH 7 with HCl.

The stability of Lipolase in these formulations at 37° C. was found to be as follows:

| | % Lipase Activity Remaining Days | | | | |
|---|---|---|---|---|---|
| Formulation | 1 | 2 | 4 | 7 | 15 |
| 2.1 | 97 | 88 | 89 | 70 | 26 |
| 2.2 | 97 | 92 | 86 | 68 | 29 |
| 2.3 | 68 | 49 | 30 | 15 | 0 |
| 2.4 | 73 | 42 | 18 | 9 | 0 |
| 2.5 | 68 | 40 | 19 | 3 | 0 |

EXAMPLE III

The liquid detergent compositions given below were prepared. Each of the compositions contained Lipolase at a level delivering 15 LU/ml when the formulations were diluted to 2 gm/l.

| Ingredients | Wt % in Formulation 3.1 | 3.2 | 3.3 | 3.4 |
|---|---|---|---|---|
| $C_{12}$-$C_{15}$ alcohol ethoxylate with 9 moles of ethylene oxide | 17 | 17 | 17 | 17 |
| Sodium $C_{11}$ alkylbenzene Sulfonate | 7 | 7 | 7 | 7 |
| Sodium Xylene Sulfonate | 4 | 4 | 4 | 4 |
| Sodium Tetra Borate Decahydrate | 4 | 4 | 4 | 4 |
| Glycerol | 6 | 6 | 6 | 6 |
| Sorbitol | 2.7 | — | 2.7 | — |
| Savinase 16L | 0.375 | 0.375 | | |
| Alcalase 2.5L | — | — | 0.75 | 0.75 |
| Water | Water to 100% | | | |

The stability of Lipolase in these formulations at 37° C. is given below.

| Formulation | Days 1 | 2 | 4 | 7 | 15 |
|---|---|---|---|---|---|
| 3.1 | 89 | 77 | 63 | 43 | 3 |
| 3.2 | 69 | 59 | 35 | 12 | 0 |
| 3.3 | 64 | 27 | 5 | 0 | 0 |
| 3.4 | 28 | 9 | 0 | 0 | 0 |

EXAMPLE IV

The liquid detergent compositions given below were prepared. Each of the compositions contained Lipolase at a level delivering 15 LU/ml when the Formulations were diluted to 2 gm/l.

| Ingredients | wt. % in Formulation 4.1 | 4.2 | 4.3 | 4.4 | 4.5 | 4.6 | 4.7 |
|---|---|---|---|---|---|---|---|
| $C_{12}$-$C_{15}$ alcohol ethoxylate with 9 moles of ethylene oxide | 17 | 17 | 17 | 17 | 17 | 17 | 17 |
| Sodium $C_{11}$ alkylbenzene sulfonate | 7 | 7 | 7 | 7 | 7 | 7 | 7 |
| Sodium xylene sulfonate | 5 | 5 | 5 | 5 | 5 | 5 | 5 |
| Sodium tetraborate decahydrate | — | 4 | — | 4 | 4 | 4 | 4 |
| propylene glycol | — | — | — | — | 5.9 | — | 5.3 |
| sorbitol | — | — | 5.9 | 5.9 | — | 5.3 | — |
| sodium formate | — | — | — | — | — | 1.5 | 1.5 |
| calcium chloride dihydrate | — | — | — | — | — | 0.5 | 0.5 |
| Savinase 16L | 0.375 | 0.375 | 0.375 | 0.375 | 0.375 | 0.375 | 0.375 |
| water | water to 100% | | | | | | |

The stability of Lipolase in these formulations at 37° C. is given below.

| Formulation | Days 1 | 2 | 3 | 5 | 6 | 8 | 9 |
|---|---|---|---|---|---|---|---|
| 4.1 | 54 | 32 | 19 | — | 3 | — | — |
| 4.2 | 17 | 9 | — | — | — | — | — |
| 4.3 | 61 | 33 | 23 | — | 8 | — | — |
| 4.4 | 86 | 66 | 53 | — | 34 | — | 12 |
| 4.5 | 71 | 39 | — | 11 | — | — | — |
| 4.6 | 81 | 68 | 60 | — | 41 | — | 18 |
| 4.7 | 71 | 49 | 37 | — | 14 | — | 4 |

EXAMPLE V

The following formulations were prepared, all containing the same amount of Lipolase as in Example III.

| Ingredients | Wt % in Formulation 4.1 | 4.2 | 4.3 | 4.4 | 4.5 | 4.6 |
|---|---|---|---|---|---|---|
| $C_{12}$-$C_{15}$ alcohol ethoxylate with 9 moles of ethylene oxide | 17 | 17 | 17 | 17 | 17 | 17 |
| Sodium $C_{11}$ alkylbenzene Sulfonate (Sodium Salt) | 7 | 7 | 7 | 7 | 7 | 7 |
| Sodium Xylene Sulfonate | 4 | 4 | 4 | 4 | 4 | 4 |
| Sodium Tetraborate (10 $H_2O$) | 4 | — | 4 | — | 4 | — |
| Glycerol | 6 | 6 | 6 | 6 | 6 | 6 |
| Sorbitol | 2.7 | — | 2.7 | — | 2.7 | — |
| Savinase 16.OL | 0.375 | 0.375 | — | — | — | — |
| Alcalase 2.5L | — | — | 0.75 | 0.75 | — | — |
| Lipolase (7500 LU/g) | | | | | | |
| Water | to 100% | | | | | |

The detergent performance of these formulations in cleaning two types of test fabrics was carried out. Test cloth A comprised a complex soil containing proteinaceous and fatty components; Test cloth B contained a fatty/particulate type of soil.

The detergency procedure was as follows: The soiled clothes (4 type A and 2 type B) were washed for 14 minutes at 40° C. in a Tergo-Tometer (United States Testing) in the presence of one liter of the test detergent solution at a concentration of 2 gm/liter. The agitation was set at 100 RPM and the wash solution contained 120 ppm hardness (as calcium carbonate, Ca/Mg 2:1). After the wash, the clothes were rinsed for five minute in tap water (100 ppm Ca/Mg 2:1) and dried. The extent of cleaning was determined from the change in reflectance measured with a Gardener colorimeter Model No. 05. All measurements were done in duplicate.

Results of these detergency evaluations are given below.

| Formulation | Change in Reflectance After Washing Delta R Test Cloth A | Test Cloth B |
|---|---|---|
| 4.1 | 18.0 | 16.2 |
| 4.2 | 10.8 | 11.0 |
| 4.3 | 19.1 | 16.5 |
| 4.4 | 14.6 | 10.8 |
| 4.5 | 5.2 | 15.0 |
| 4.6 | 5.5 | 10.4 |

The above results demonstrate the improvement which the incorporation of the higher polyol/borate has on detergency performance of the protease/lipase containing formulations. In the absence of protease the incorporation of sorbitol/borate does not have a perceptable effect on performance of the Type A cloth which contains a proteinaceous soil.

The following formulations were prepared and the half-life ($t_{\frac{1}{2}}$) of Lipolase measured.

| | Control | I | II |
|---|---|---|---|
| C11.5 Alkyl Benzene Sulfonate | 28.0 | 28.0 | 28.0 |
| $C_{12}$-$C_{15}$ Alcohol Ethoxylate (9 E.O.) | 12.0 | 12.0 | 12.0 |
| Sodium Citrate 2 $H_2O$ | 10.0 | 10.0 | 10.0 |
| Sodium Borate 10 $H_2O$ | 3.5 | 3.5 | 3.5 |
| Glycerol | 5.0 | 5.0 | 5.0 |
| $CaCl_2$ | 0.02 | 0.0 | 0.0 |
| Sorbitol | 0.0 | 5.0 | 13.1 |
| Savinase 16.0/L | 0.75 | 0.75 | 0.75 |
| Lipolase 100/L | 3.0 | 3.0 | 3.0 |
| Water | | to 100% | |

| Lipolase Stability | | | |
|---|---|---|---|
| $t_{\frac{1}{2}}$* (temp. @ 37° C.) | 5 days | 14 days | >34 days |

*The time required for Lipolase to lose one half of its initial activity.

A typical formulation is as follows:

| | |
|---|---|
| $C_{11.5}$ (Average) Alkyl Benzene Sulfonate | 25 to 30% |
| $C_{12}$-$C_{15}$ Alcohol Ethoxylate (9 E.O.) | 10 to 14% |
| Sodium Citrate.2 $H_2O$ | 6 to 15% |
| Sodium Borate.10 $H_2O$ | 3 to 8% |
| Glycerol | 3 to 8% |
| Sorbitol | 5 to 15% |
| Proteolytic Enzyme | 0.1 to 2% |
| Lipolytic Enzyme | 0.1 to 5% |
| Detergent Adjuncts | 0.1 to 10% |
| Water | balance to 100% |

What is claimed is:

1. An enzymatic liquid detergent and cleaning composition comprising, in a liquid medium, from 0-90% by weight of a detergent-active compound, wherein the detergent active compound includes 0 to 40% of an anionic surfactant selected from the group consisting of alkyl benzene sulfonates, alkyl sulfates, and alkyl ethoxy sulfates in combination with 0 to 40% of a nonionic surfactant selected from the group consisting of alcohol alkoxylates, alkyl phenol alkoxylates, alkyl polyglucosides, and alkyl glycerol ethers;

0.1 to 50 GU/mg of the final composition of a proteolytic enzyme and 0.005 to 100 LU/mg of the final composition of a lipolytic enzyme, said lipolytic enzyme being selected from the group consisting of fungal lipases obtainable from *Humicola lanuginosa* and *Thermomyces lanuginosus*, and bacterial lipases which show a positive immunological cross-reaction with the antibody of the lipase, produced by *Chromobacter viscosum* var. *lipolyticum* NRRL-B3673;

from 0 to 30% of a detergent builder selected from the group consisting of alkali metal salts of citric acid, copolymers of acrylic and maleic acid, oxydisuccinate, tartrate monosuccinate/tartrate disuccinate, C8 to C18 carboxylic acids, zeolites, and combinations thereof;

a lipolytic enzyme stabilizing system comprising a mixture of 1 to 20% of a first polyol containing only C, H and O atoms and containing at least two hydroxyl groups, and 1 to 10% of a boron compound which is capable of reacting with said first polyol, wherein said first polyol has a first binding constant with said boron compound of at least 500 l/mole and a second binding constant of at least 1,000 $l^2$/mole$^2$; and 0.1 to 10% of a proteolytic enzyme stabilizing system selected from the group consisting of i) a second polyol being selected from the group consisting of glycerol, propylene glycol and mixtures thereof combined with sodium tetraborate; ii) alkali metal salts of $C_{1-4}$ carboxylic acids; iii) calcium salts and combinations thereof.

2. A liquid detergent consisting essentially of:

| | |
|---|---|
| $C_{11.5}$ (Average) Alkyl Benzene Sulfonate | 25 to 30% |
| $C_{12}$-$C_{15}$ Alcohol Ethoxylate (9 E.O.) | 10 to 14% |
| Sodium Citrate 2 $H_2O$ | 6 to 15% |
| Sodium Borate 10 $H_2O$ | 3 to 8% |
| Glycerol | 3 to 8% |
| Sorbitol | 2 to 15% |
| Proteolytic Enzyme | 0.1 to 2% |
| Lipolytic Enzyme | 0.1 to 5% |
| Detergent Adjuncts | 0.1 to 10% |
| Water | balance to 100% |

* * * * *